United States Patent [19]

Wallter et al.

[11] Patent Number: 4,676,049

[45] Date of Patent: Jun. 30, 1987

[54] PACKAGING METHOD AND A DEVICE THEREFORE

[75] Inventors: Göte Wallter, Malmö; Göran Lindstam, Lund, both of Sweden

[73] Assignee: AB Akerlund & Rausing, Sweden

[21] Appl. No.: 651,797

[22] Filed: Sep. 18, 1984

[30] Foreign Application Priority Data

Sep. 30, 1983 [SE] Sweden ..... 83053561

[51] Int. Cl.[4] ..... B65B 47/02; B65B 47/10; B65B 53/06

[52] U.S. Cl. ..... 53/433; 53/141; 53/453; 53/487

[58] Field of Search ..... 53/141, 290, 329, 433, 53/453, 478, 487, 511, 559, 561; 264/545, 553; 425/405 R, 522, DIG. 60

[56] References Cited

U.S. PATENT DOCUMENTS

| | | | |
|---|---|---|---|
| 2,958,168 | 11/1960 | Vogt | 53/141 X |
| 3,383,260 | 5/1968 | Mojonnier | 53/329 X |
| 3,545,163 | 12/1970 | Mahaffy et al. | 53/511 X |
| 3,956,867 | 5/1976 | Utz et al. | 53/433 |
| 4,034,536 | 7/1977 | Mahaffy et al. | 53/453 X |
| 4,294,056 | 10/1981 | Paulsen et al. | 53/559 X |
| 4,366,663 | 1/1983 | Grebe | 53/559 |

*Primary Examiner*—E. R. Kazenske
*Assistant Examiner*—Michael D. Folkerts
*Attorney, Agent, or Firm*—Lerner, David, Littenberg, Krumholz & Mentlik

[57] ABSTRACT

A method of forming a form stable, preferably product contour tight package in a roller operated packaging machine. A thermoformable web (14) is pre-heated to a suitable forming temperature and the web is thereafter supplied to a mould tray (20). The tray is provided with vacuum passages and/or other arrangements for forced forming to the contour of the tray. A sealing tool (22) surrounds, completely or partly, the periphery of the tray and is used for sealing of the second web to the first one. The heat of the sealing tool is superposed, primarily by heat radiation, onto the cooling, preferably such that a boarder region (26) head/cold is created in the marginal portion of the mould tray.

6 Claims, 3 Drawing Figures

PACKAGING METHOD AND A DEVICE THEREFORE

FIELD OF THE INVENTION

The present invention relates to a method of packaging products in roller operated packaging machines of the thermoforming type and an arrangement in such machines for carrying out the method. By the term roller operated packaging machine is meant a machine where a pair of webs, usually foils of plastics or laminates of plastics, are used for in-line filling and forming of a complete package.

BACKGROUND OF THE INVENTION

The problem behind the invention is to provide an improved packaging method in a roller operated machine.

The problem is also related to the provision of an advantageous alternative to the fold free contour tight packaging method obtainable in packaging machines of the chamber type.

The term chamber machine means a machine where a pouch with the contents thereof is loaded into a vacuum chamber for sealing and shrinking the pouch into a contour tight shape.

Basically, it is also known to pack contour tight between webs. Goods to be packed, for instance for products such as pieces of meat, are placed between a planar heat shrinkable upper web and a lower thermoformable web having cavities formed therein. After having sealed the webs together after creating a vacuum, the upper web is melted by heat transfer. The melting effect is such that the upper web falls down onto the product which will be enclosed contour tight between the webs without folds.

As such, the known methods give a proper end product from a chamber machine and a roller operated machine, respectively. However, there are some shortcomings. It is desirable to be able to provide a broader forming and filling range and offer a more form stable, rigid packaging construction compared to what is obtainable by the known methods. By forming and filling range is meant a range not restricting the forming depth and filling degree to very strict intervals, especially when a true contour tight package is desired.

SUMMARY OF THE INVENTION

The object of the present invention is to provide a packaging method and a machinery which do not have the short-comings of known methods and machines.

In the broadest sense thereof the invention provides a method of providing a sealed package from a pair of material webs in a roller operated packaging machine. The method comprises the steps of:

thermoforming upwardly open cavities in a first web of a thermoformable material, filling the cavities with a product to be packed, thermoforming second cavities in a second web of a thermoformable material, form stabilizing said second cavities, bringing the product into contact with said second cavities first after said stabilization, and sealing the webs together such that pairs of cavities in the first and the second web, respectively, form a completed package, where the form stabilized cavity is the product supporting part of the package.

In the preferred embodiment the method comprises the additional steps of: thermoforming second cavities in said second web in at least one mould tray in a tool, and heat-sealing each cavity around the margin thereof by said first web in the same mould tray by means of a sealing tool which at least partly surrounds the mould tray.

Advantageously, the preferred method also includes the steps of:

heating the second web to the forming temperature thereof before it is supplied to the mould tray, and cooling the mould tray to a temperature for form stabilization of the cavity.

In one version the cooling of the mould tray is such that the marginal region assumes a higher temperature than the rest of the tray.

A preferable temperature distribution may be realized by for instance intensifying the heat radiation between the sealing tool and the mould tray in the marginal region.

In order to realize the desired end result the lower web is formed to a substantially product contour tight form by creating a vacuum in the region between the webs in combination with heat, preferably contact heat and/or a hot fluid, possibly supported by an external over-pressure.

Preferably there are such arrangements that the marginal region of the mould tray is heated by radiation and/or convection from the sealing tool.

The arrangement according to the invention for carrying out a method of forming a sealed package from a pair of material webs in a roller operated packaging machine comprises:

a forming tool having at least one mould tray for thermoforming a cavity in one of said material webs of a thermoformable material, a sealing tool surrounding said tray for sealing of the marginal region of said pair of material webs surrounding said tray, and cooling channels arranged in the mould tray for providing a form stabilization environment.

DESCRIPTION OF A PREFERRED EMBODIMENT

Figure 1:
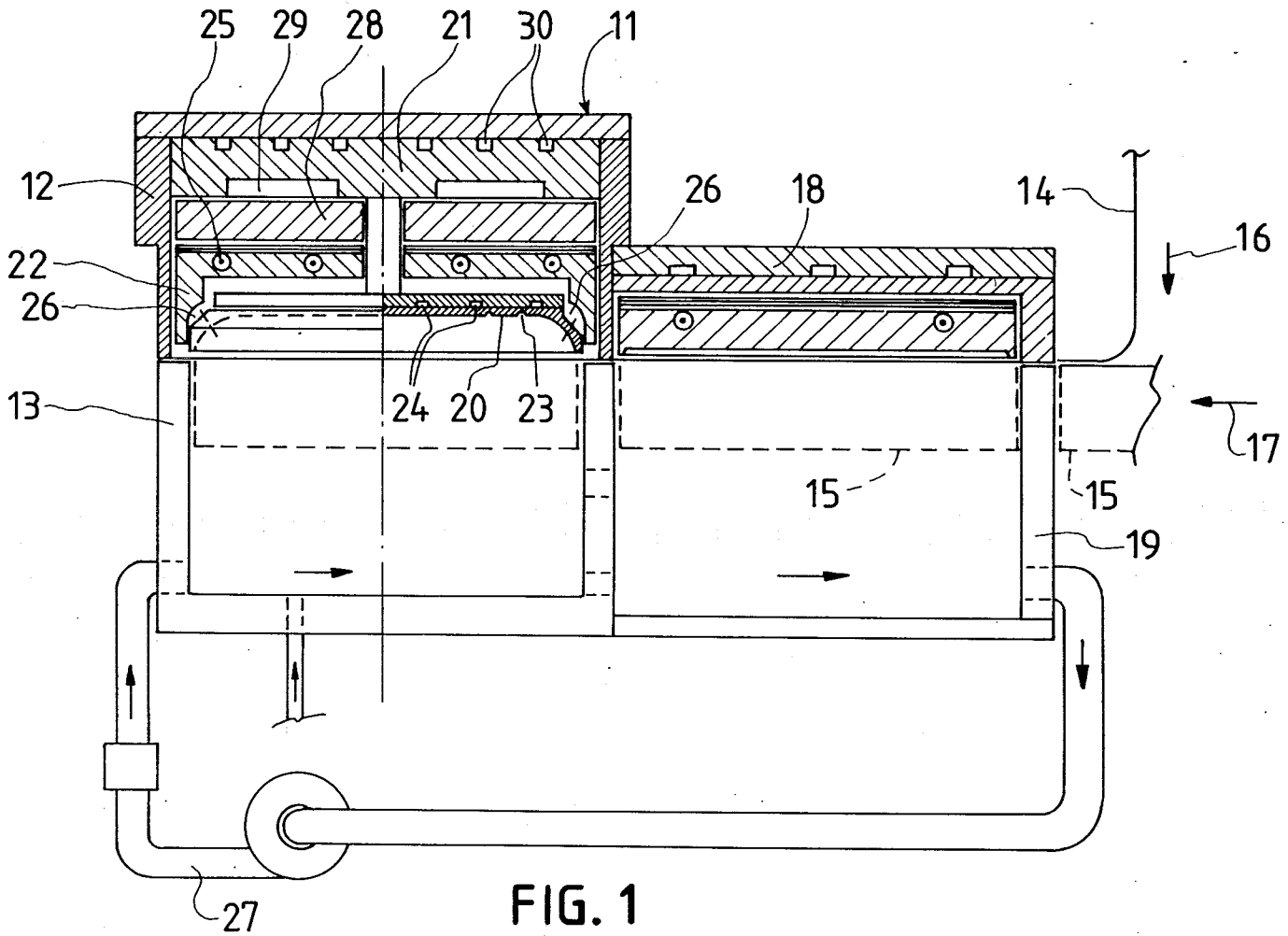
FIG. 1 is a schematic longitudinal section through a part of a device for carrying out the method.

In a preferred embodiment the mould tray and the sealing tool are arranged for operating on the upper web.

In a stand 10 there is supported a forming and vacuum unit 11. Basically the unit 11 comprises a fixed part 12 (may be movable when larger forming depth are required) and a vertically movable part 13. A thermoformable upper web 14 and lower web 15, also thermoformable, are fed to the unit 11 in the direction of the arrows 16 and 17, respectively, when the movable part 13 is in the lower position thereof (not shown). The upper web is of a plastics material having enough thermoforming ability and sufficient strength characteristics for acting as the product supporting part of the package after the forming operation.

The upper web 14 for instance consists of a PVC-web or a laminate based on PVC.

The lower web 15 is of a well heat shrinkable material, for instance a laminate of polyamide and an ionomer, having cavities formed in advance (in the machine), as schematically indicated in FIG. 1.

The upper web 14 is heated to a suitable forming temperature in a pre-heating unit 18 attached to the stand 10. The lower part 19 of the unit is attached to the movable part 13 and may be provided with a heat supplying arrangement, for instance heating coils, for preheating of the already formed cavities (in the lower web 15) in order to facilitate a "shrinking operation" of the lower web but also of the marginal portions of the cavities in the upper web (as will be discussed later on).

There is a mould tray 20 in the fixed part 12 and in the embodiment shown said tray is rigidly attached to the cooling plate 21 of a sealing tool 22. Basically the cooling plate 21 is of the same type as plates normally found in sealing tools of roller operated machines, and the function thereof is to cool the air flow that attacks the marginal areas of the webs 14 and 15 which are heated to welding temperature by a sealing tool/welding plate 22, after the webs have been pressed together by the welding plate and the part 13, and when the forming chamber comprising the parts 12 and 13 again is arranged in communication with the atmosphere.

The cavity (shown by broken lines) pre-formed in the lower web arrives in the movable part 13. After the parts 12 and 13 have been brought together to the position shown, the forming operation of the upper web 14 starts. The mould tray 20 is provided with a number of passages 23 which now are brought into communication with a vacuum source. In the mould tray there are also cooling channels 24 that communicate with a source of cooling medium, in this particular case water. When the upper web abuts the mould tray there will be a cooling effect which is controlled by a proper circulation of water. The result will be a form stable upper part. However, the welding plate 22 is now hot (heating from the heating coils 25) meaning super-position of primarily radiation heat on the cooling from the water. The wall thickness of the tray that has been shown on the drawings and also the wall thickness of the welding plate and the distance between the tray and the plate will create a transfer zone 26 heat/cold in the marginal region of the tray when there is a certain circulation rate of water.

This transfer zone plays an interesting role when forming (after-forming) the cavity in the lower web and the marginal portion of the upper web into a fold free/-product contour tight shape.

The effect normally used when thermoforming for providing such shrinking (after-forming) originates from the very fact that the heat supply returns a previously, at under-temperature, formed cavity to the original shape thereof. The term under-temperature means a temperature where the molecule orientation (memory of the material) is not lost.

In the embodiment that has been shown the lower part 13 supplies contact heat when the cavity (preferably formed at under-temperature at the very beginning) is sucked down (there are suction channels, not shown, in the lower part). However, instead of contact heat or in combination therewith, a hot fluid, for instance air, may be brought into contact with the web through a closed circulation system 27.

The heat from the lower part 13 and/or the system 27 in combination with the hot marginal zone 23 of the mould tray 20 provides the heat energy necessary for the shrinkage (after-forming). This forming may additionally vary in the marginal region (also as to extension) as well as in the lower web. However, the type of material used for the lower web is of importance, especially when larger forming depths are required. A suitable material is a laminate of polyamide and an ionomen. Also when the product to be packed does not fill the available total "packaging area" fully, a lower web having a high shrinkage characteristics is preferable. The term packaging area means the available goods supporting area of each package comprising a "lower" shrinkable film and a form stabilized "upper" tray.

The welding plate 22 is operated by a pressure plate 28. This plate is manipulated in a manner known per se by a membrane chamber 29 operated by pressurized fluid and provided in the cooling plate having cooling channels.

Figure 2:
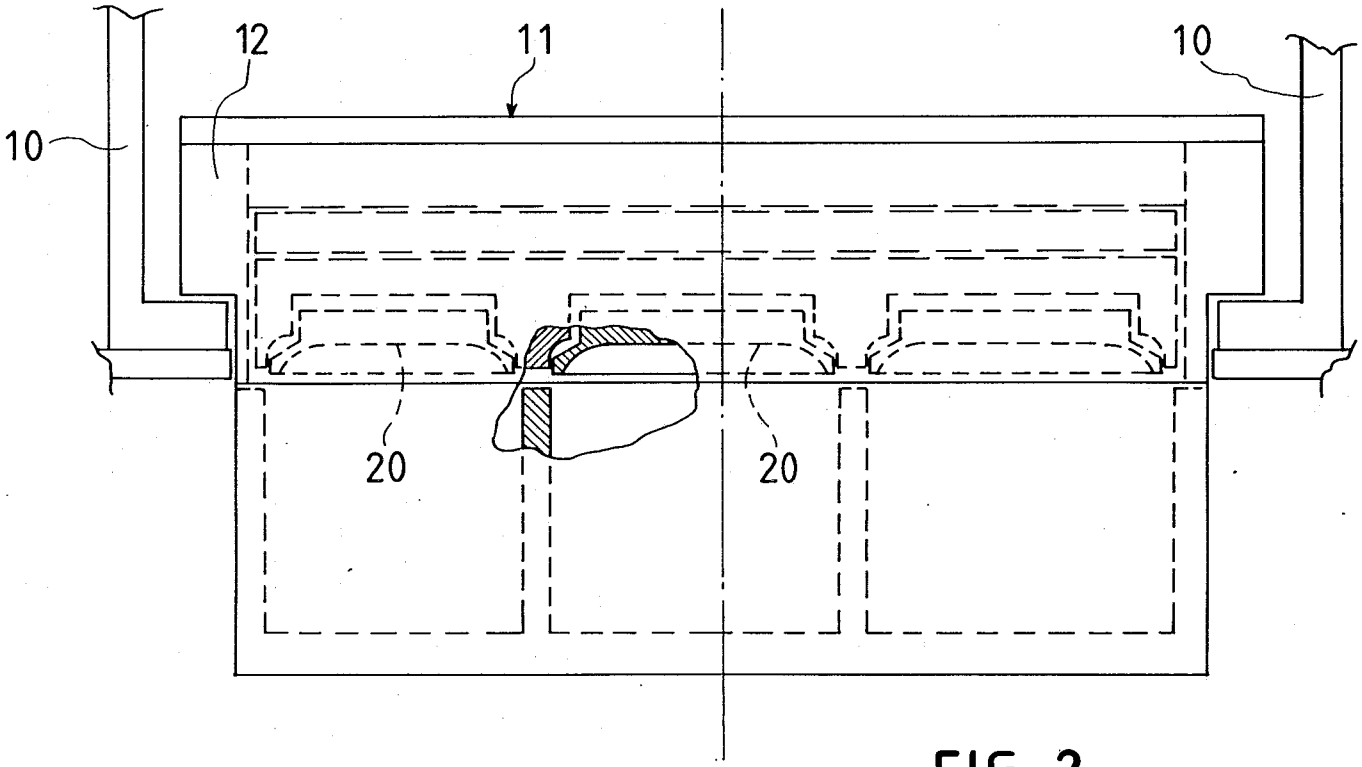
FIG. 2 is a cross-section through the part in FIG. 1, and FIG. 3 schematically shows another type of forming operation, positiv forming, in the upper web.

In FIG. 2 there is shown in cross-section three mould trays 20 and the welding plates, etc. thereof in the particular case where the web width corresponds to the width of three mould trays.

The manner in which the vacuum forming takes place in the unit 11 is the normal one within the field and there is no need for a detailed description. However, it may be mentioned that the pressure is reset in the chamber formed by parts 12 and 13 such that a plus pressure is obtained in the lower part before the parts are separated after welding. The upper part will be in contact with the form mould the whole time.

Figure 3:
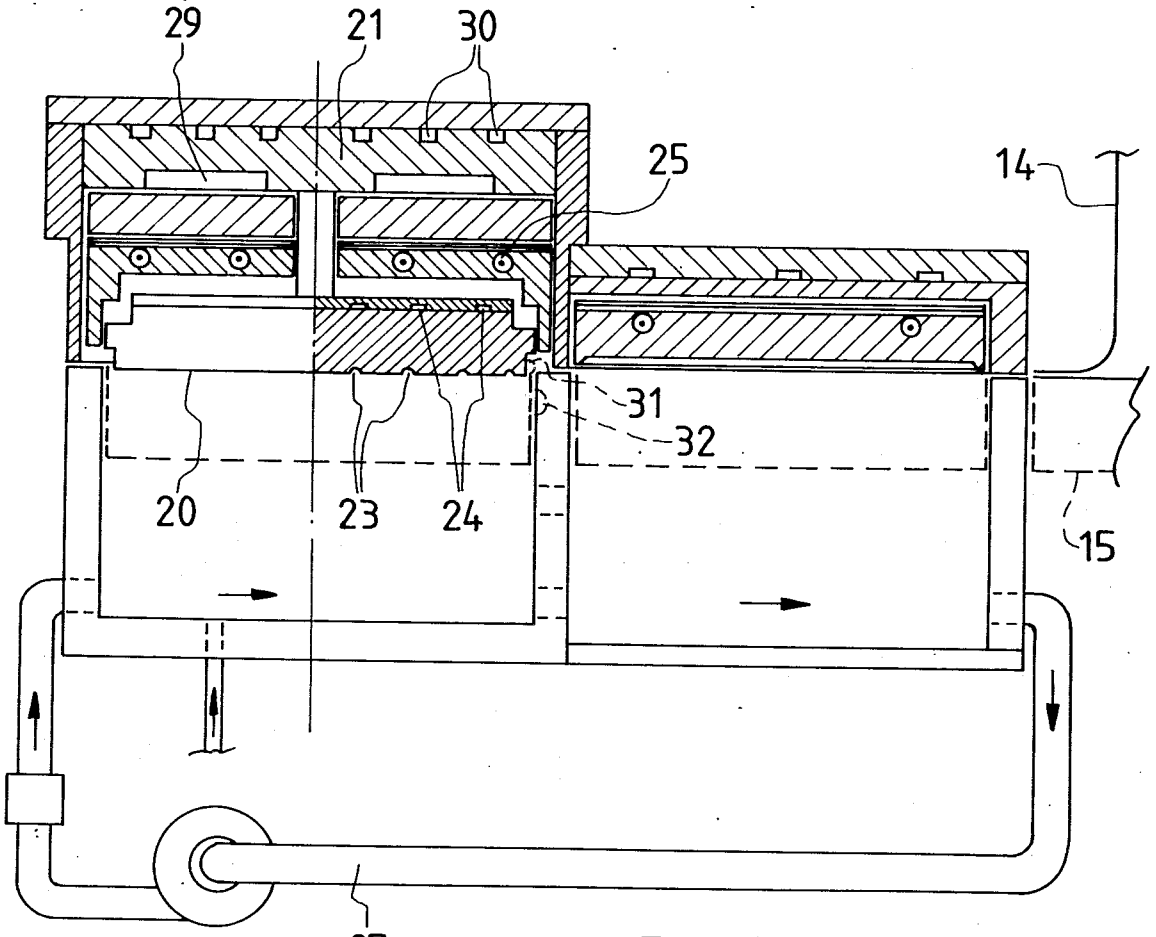

In FIG. 3 there is schematically shown a "positiv" mould tray 20'. The mould tray and the form (forms) for forming of cavities in the lower web may be arranged with extensions 31 and cut-outs 32. In this particular case the mould tray is vertically movable. In connection herewith it may also be of interest to supply gas to the product that is packed.

What we claim is:

1. A method of forming a sealed package from a pair of material webs in a roller operated packaging machine, comprising the steps of supplying a first and second web of thermoformable material to a packaging machine, thermoforming upwardly open first cavities in said first web, filling said first cavities with a product to be packaged, thermoforming second cavities in said second web in at least one mould tray provided in a tool, form stabilizing said second cavities, bringing said product within said first cavities into contact with said second cavities first after said form stabilizing, forming said first web into a substantially product tight shape by application of heat thereto, and heat-sealing a margin of said second cavities to a margin of one of said first cavities in the same mould tray by means of sealing tool which at least partly surrounds said mould tray and heating only a marginal region of said mould tray by said sealing tool so as to form the marginal portion of each of said second cavities into a substantially product tight shape such that pairs of said cavities in said first and said second web, respectively, form a completed package therefrom, whereby the form stabilized second cavities are the product supporting part of said package.

2. A method as in claim 1, further comprising the steps of heating said second web to the forming temperature thereof before it is supplied to said mould tray, and cooling said mould tray to a temperature for form stabilization of said second cavities.

3. A method as in claim 2, further comprising the step of cooling said mould tray such that said marginial region of said mould tray assumes a higher temperature than the rest of said mould tray.

4. A method as in claim 3, in which said step of heating said marginal region of said mould tray includes the step of providing heat radiation between said sealing tool and said mould tray such that said heat radiation is more intense in said marginal region.

5. A method as in claim 1, further comprising the step of creating a vacuum between said first and second webs in combination with an external over-pressure.

6. The method as in claim 1 wherein said thermoforming upwardly open first cavities comprises heating said first web to a temperature where the molecular orientation of said web is retained, whereby said first web possesses memory.

* * * * *

UNITED STATES PATENT AND TRADEMARK OFFICE

CERTIFICATE OF CORRECTION

PATENT NO. : 4,676,049

DATED : June 30, 1987

INVENTOR(S) : Wallter, et al

It is certified that error appears in the above-identified patent and that said Letters Patent is hereby corrected as shown below:

Column 4, line 51, after "margin of" insert --each--.

Signed and Sealed this

First Day of December, 1987

*Attest:*

DONALD J. QUIGG

*Attesting Officer*

*Commissioner of Patents and Trademarks*